United States Patent [19]

Gingle et al.

[11] 4,194,331

[45] Mar. 25, 1980

[54] SYSTEM FOR ENHANCING THE PROPERTIES OF WINDOWS AND THE LIKE

[76] Inventors: Alan R. Gingle, 5728 S. Blackstone, Apt. 308, Chicago, Ill. 60637; Terrance D. Gingle, 1136 E. Cunningham Dr., Palatine, Ill. 60067

[21] Appl. No.: 897,229

[22] Filed: Apr. 17, 1978

[51] Int. Cl.[2] ..... E06B 3/64; E06B 3/28

[52] U.S. Cl. ..... 52/203

[58] Field of Search ..... 52/203, 202, 172

[56] References Cited

U.S. PATENT DOCUMENTS

| | | | |
|---|---|---|---|
| 1,777,435 | 10/1930 | Hogelund . | |
| 2,012,388 | 8/1935 | Goodman . | |
| 2,098,127 | 11/1937 | Auger | 52/203 |
| 2,111,343 | 3/1938 | Walz | 52/203 |
| 2,581,666 | 1/1952 | Johnson . | |
| 2,595,833 | 5/1952 | Flaherty . | |
| 3,175,603 | 3/1965 | Tonnon | 52/203 |
| 3,563,594 | 2/1971 | London . | |
| 3,679,505 | 7/1972 | Hinderaker et al. . | |
| 3,805,872 | 4/1974 | Lorber . | |
| 3,971,178 | 7/1976 | Mazzoni et al. | 52/203 |
| 4,044,813 | 8/1977 | Emmons . | |

FOREIGN PATENT DOCUMENTS

| | | | |
|---|---|---|---|
| 7512066 | 4/1977 | Netherlands | 52/203 |
| 1143256 | 2/1969 | United Kingdom | 52/203 |

*Primary Examiner*—J. Karl Bell

*Attorney, Agent, or Firm*—Neuman, Williams, Anderson & Olson

[57] ABSTRACT

A system for double glazing existing panes in windows or the like in which a pane of translucent or lightaltering material is cut to the shape of the exposed surface of an existing windowpane within its sash. The additional pane is secured to the existing pane through the use of magnetically intermateable spacer strips which are secured to the added and existing panes around their outer periphery by means of an adhesive. The intermateable spacer strips are of a thickness which allows for separation of the two panes by a sufficient distance to create an air space therebetween to enhance the insulating properties of the structure. A thin flexible strip of decorative material is secured to the surface of the attachable pane opposite the existing pane along its periphery so as to overlap the adhesive on the opposite face of the attached pane while extending outward to overlap the inside edges of the sash and thereby additionally seal and insulate the area around the outer periphery of the attached pane. A method for applying the attached pane to the existing pane is also disclosed.

10 Claims, 10 Drawing Figures

SYSTEM FOR ENHANCING THE PROPERTIES OF WINDOWS AND THE LIKE

FIELD OF THE INVENTION

This invention is related to the art of window glazing and in particular relates to insulating panes of the removeable type.

BACKGROUND OF THE INVENTION

With the increasing cost of heating fuels and the recognition of a desirability to conserve energy, the art of insulating homes, and in particular the insulating of existing windows and doors, is receiving continuing and increased attention. A substantial percentage of a home's heat loss is through the glass panes of windows and doors.

Traditional means of insulating against this loss have included the use of heavy and expensive storm windows, the glass of which requires separate frames of wood or aluminum. In addition to the weight, expense and attention associated with windows of this type, they normally interfere with and detract from the beauty of the windows from both the inside and outside.

Another popular means of insulating the window area is the provision of insulating glass which is manufactured in multiple thicknesses of either two or three sheets, each separated by an air space from the other, prior to assembly into the sash. While the insulating capabilities of glazing of this type are far superior to those of a single glass pane, the increased cost of multiple thickness glazing has discouraged its use in many instances. In addition, double glazing has heretobefore been impractical for windows which have an existing single pane, since the sash is not designed to accomodate the increased weight and thickness of the double glazed glass panels.

SUMMARY OF THE INVENTION

The present invention overcomes the aforesaid drawbacks of existing insulating techniques in that it has as its principal object the capability of providing an extra thickness of material plus an insulating air space for existing single-pane windows without extensive modification or additions to the sash or framing structure of the window. More specifically, it is an object of the present invention to provide an insulating glass pane which is attachable to an existing single pane window with a minimum of effort and which is, nonetheless, fully detachable for cleaning or storage purposes.

It is the further object of the present invention to provide a removeable insulating glass which has enhanced insulating capabilities due to the fact that the air space between the existing pane and the insulating translucent surface can be increased over that available in conventional double or triple glazed windows.

It is still a further object of the invention to provide a capability for adding light altering, dispersing, reflecting, or absorbing properties to existing window assemblies.

The aforesaid objects and others are achieved through the provision of a removeable insulating pane of translucent material which is adhered to the existing windowpane along the periphery thereof by magnetically mateable stripping which serves the additional purpose of spacing the two panes to create a desirable air space. To further enhance the insulating properties of the structure and to provide a pleasing visual appearance, decorative edge stripping is applied to the outer surface of the mounted insulating pane to overlap the magnetically intermateable spacer strips while substantially sealing the edge area between the insulating pane and the window sash.

The use of light-altering materials for the supplemental pane makes the system applicable to a variety of additional tasks. For example, the attachment of light-reflective panes to a window provides the dual benefits of enhancing the privacy of the adjacent area while reducing the passage of light rays, and hence the creation of solar heat, within the area. Summertime air conditioning costs can be reduced as a result. A similar result is achieved through the use of tinted panes having light absorbing or dispensing properties. Tinted panes may also be attached during winter seasons for applications in which it is desirable to reduce excessive glare due to snow reflection or the like. Totally opaque panes may be used for temporary room darkening applications such as in an infant's bedroom or a photographic darkroom. For each of the applications set forth above, the attachable system of the present invention is particularly suitable for allowing temporary or selective alteration of the light passing properties of the existing translucent panes.

Other objects and advantages of the invention will become apparent upon reading the following detailed description and appended claims and upon reference to the accompanying drawings.

While the invention will be described in connection with certain preferred embodiments, it will be understood that we do not intend to limit the invention to those embodiments. On the contrary, we intend to cover all alternatives, modifications and equivalents as may be included within the spirit and scope of the invention as defined by the appended claims.

DESCRIPTION OF THE PREFERRED EMBODIMENT

Figure 1:
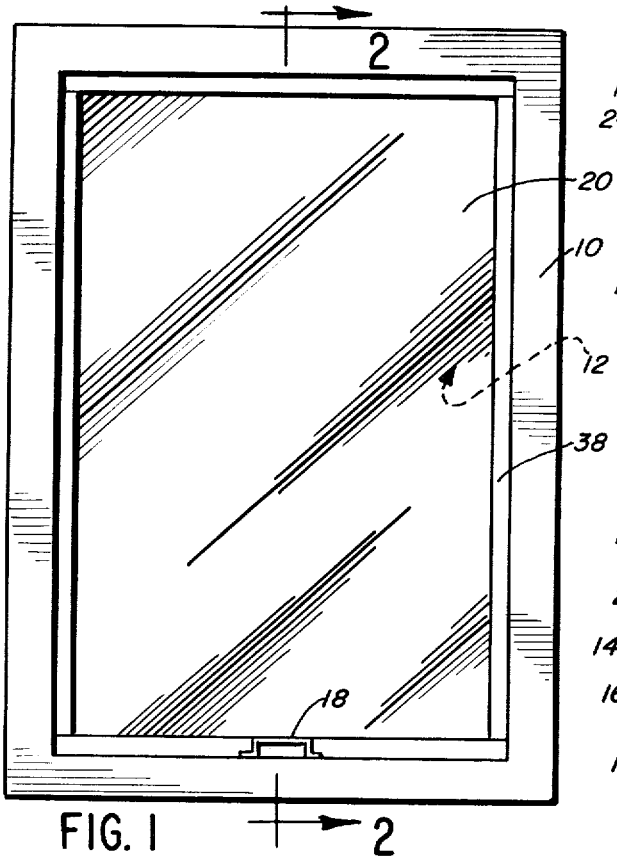
FIG. 1 is a front elevation view of a window assembly with the insulating pane of the present invention attached.
Figure 2:
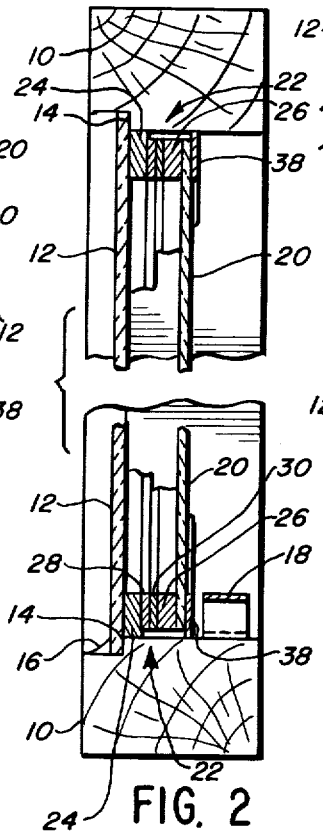
FIG. 2 is a sectional view taken along the lines 2—2 of FIG. 1 to show the installation of the insulating pane.
Figure 3:
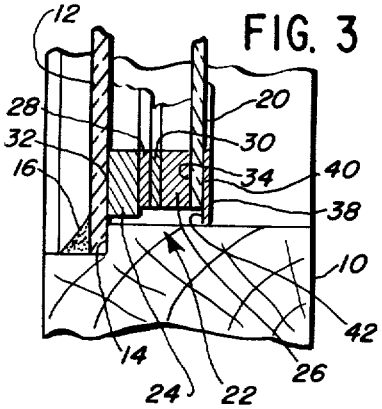
FIG. 3 is an enlarged cross sectional view of the apparatus shown in the lower portion of FIG. 2.

Turning now to the principle embodiment of the present invention as shown in FIGS. 1, 2 and 3, there is shown a conventional window frame 10 typically made of wood and surrounding a fixed, translucent pane 12. The translucent pane 12 is secured to the sash 10 in a recess 14 and is held in position with a suitable silicone or caulk bead 16 which seals the periphery of the pane 12 against the weather. The sash 10, as shown, is substantially rectangular in form and has mounted thereon a handle 18 or other suitable hardware for opening, closing, or locking (securing) the window.

While the invention id described in connection with a typical window, it will be appreciated that the invention is equally applicable to weather-resistant doors and windows of various sizes and shapes and to existing panes of various materials including glass, plastics and acrylics.

In accordance with the present invention means are provided for insulating the fixed pane 12 and window assembly 10 by providing a capability for double-glazing of the existing window without removal thereof or substantial modification to existing components. To this end, a second and removeable pane 20 of flat translucent material is shown in spaced, parallel relation to the fixed pane 12. Various materials such as glass, plastic, nylon or the like may be used for the removeable pane 20 depending upon the intended use. Particularly desirable panes have been made from acrylic sheets which are light in weight and flexible enough to allow for ease of removal and application. For holding the pane 20 in its parallel relationship to the pane 12 there is provided a spacer strip assembly 22 (FIGS. 2 and 3) consisting of a pair of intermateable portions 24 and 26 each of which have integral magnetic faces, 28, 30 respectively, integrally formed onto adjacent sides thereof. The opposite sides of the spacer portions 24, 26 are adhesively bonded to the fixed and insulating panes 12 and 20 respectively, along facing surfaces 32 and 34 of the panes 12 and 20. The spacer strip assembly 22 extends substantially around the periphery of of the spaced parallel panes to create an air space between the panes which enhances the insulating capabilities thereof. The thickness of the portions 24, 26 of the spacer strips 22 may be varied during manufacture in accordance with the air space and rigidity requirements of the insulating assembly.

The spacer portions 24 and 26 of the strip assembly 22 typically consist of synthetic foam which lends to the assembly a substantial degree of flexibility in addition to the inherent insulating properties associated with such foam. The resilience in the spacer strip material thus allows the panes to flex independent of one another under the force of wind, rain, or other environmental forces without significant danger of cracking due to the compounded rigidity of parallel panes.

While the mating surfaces 28 and 30 shown in FIGS. 1-3 are preferably made of oppositely poled magnetic materials for ease of application and removal, other selectively engageable and disengageable surfaces may be used with comparable degrees of effectiveness. For example, in certain instances it will be preferable to use a VELCRO-type fastener surface, which employs intermating meshes of minute plastic or nylon projections. Unlike magnetic surfaces, mechanically intermatable surfaces of the latter type will generally intermate successfully over the majority of their surface area in spite of localized dirt or obstructions of other types preventing full engagement along the entire surface area.

In accordance with another aspect of the present invention means are provided for sealing the periphery of the parallel-pane assembly for the dual purposes of enhancing the insulating qualities thereof while covering the generally undesirable visual appearance of the adhesive bond between the spacer portion 26 and the insulating pane 20 along the surface 34. To this end there is provided a trim strip 38 which surrounds the periphery of the insulating pane 20 and overlaps the adhesive portion lying thereunder. The strip 38, shown in more detail in FIG. 6, includes a first lateral portion 40 which is adhesively bonded to the insulating pane 20 and a second lateral portion 42 which extends beyond the periphery of the insulating pane 20 (which is typically sized slightly smaller than the opening within the sash 10) into substantial engagement with the sash 10 (see FIG. 3).

Figure 4:
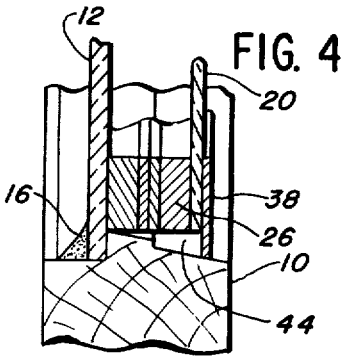
FIG. 4 is an enlarged cross sectional view similar to those of FIGS. 2 and 3 showing application of the invention to a modified form of window sash.

As shown in FIG. 4, the position of the peripheral stripping 38 makes the present invention adaptable to a plurality of different window and sash styles. The sash shown in FIG. 4, for example, is set at an angle with respect to the panes 12 and 20, creating a greater air space 44 about the periphery of the pane 20 than would otherwise be created with a sash of the style shown in FIGS. 1-3. By simple adjustment of the location of the trim strip 38 in accordance with the method described below, the additional air space area 44 may be sealed off with no difficulty.

Figure 7:
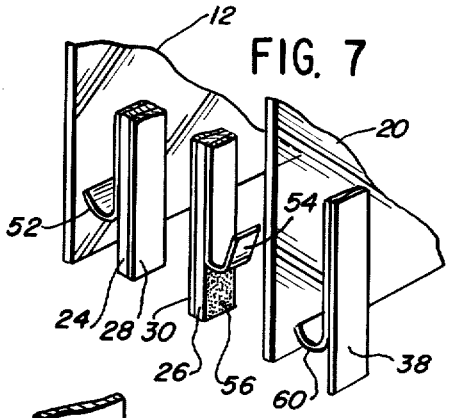
FIG. 7 is a perspective fragmentary view, partially exploded, illustrating the method of using the various components of the insulating assembly.
Figure 6:
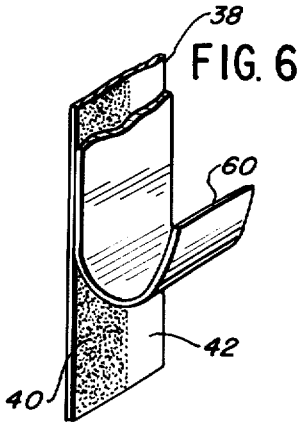
FIG. 6 is a perspective view of a portion of the trip strips used with the present invention.
Figure 5:
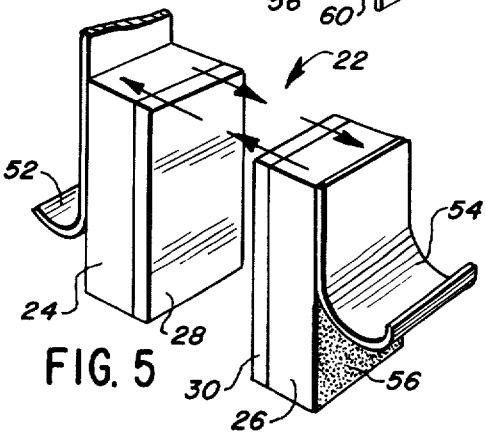
FIG. 5 is a perspective exploded view of the spacer strips shown in FIGS. 2–4 prior to installation.

The method of applying the apparatus of the present invention to an existing window pane is illustrated in FIGS. 5, 6 and 7. In FIG. 5 the portions 24 and 26 of the spacer strip 22 are depicted as they exist prior to assembly. The arrows at the top of the strips indicate the magnetic interaction which normally holds the magnetized portions 28 and 30 into locked engagement. Prior to assembly the outer surfaces of the spacer portions 24 and 26 have a removable protective film or cover stripping 52, 54 respectively, protecting the underlying adhesive 56. Thus to initiate the installation, the spacer portions 24 and 30 are first stripped of their protective film 52 to reveal the adhesive 56 lying thereunder. The underlying adhesive-bearing surface is carefully applied along the periphery of the pane 12 until it substantially surrounds the edge of the pane. While the portions 24 and 26 of the spacer strip assembly 22 are still magnetically intermated, the protective film 54 is removed from the outside of the spacer portion 26 to reveal its underlying adhesive 56. The insulating pane 20, which is previously cut to a size slightly smaller than the opening in the sash 10, is then pressed onto the exposed adhesive 56 and allowed to mate therewith about its entire periphery. The insulating pane 20 is now detachable due to the fact that the adhesion between the spacer portion 26 and the insulating pane 20 is stronger than the magnetic interaction between the opposed faces 28 and 30 of the spacer strip portions 24 and 26.

If it is then desired to seal the edges and conceal the irregular appearance of the adhesive 56 surrounding the periphery of the insulating pane 20, the trim strip 38 may then be stripped of a protective film 60 to reveal its adhesive portion 40. The strip 38 is selectively applied about the periphery of the insulating pane 20 with the nonadhesive coated portion 42 of the trim strip 38 extending beyond the periphery of the insulating pane 20 into substantial engagement with the sash. Having applied the trim strip 38 around the entire periphery of the insulating pane 20, the installation is effective to create an insulating air space between and around the spaced, parallel panes 12 and 20 within the sash 10.

For cleaning or storage purposes, it may thereafter be desirable to remove the insulating pane 20. This is done simply by exerting sufficient pressure to break the magnetic seal between the opposed faces 28 and 30 of the spacer strip assembly 22.

Figure 8:
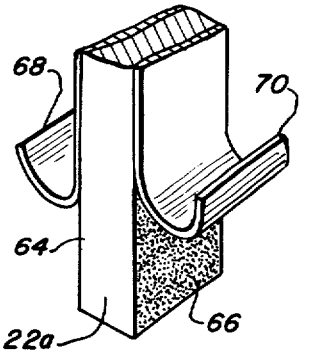
FIG. 8 is a perspective view of an alternate form of spacer strip for use with the invention.

FIG. 8 shows a modified and somewhat simplified embodiment of the present invention in which the spacer strip assembly, depicted at 22*a*, is a one-piece composite structure having opposite faces 64 and 66 coated with adhesive and protected by suitable removable films 68 and 70 respectively. Consistent with the previous embodiment, the spacer strip 22*a* has a medial portion which is preferably made of a semi-flexible synthetic foam. A one-piece spacer strip of the type described is designed for permanent or semi-permanent installations of the insulating glass. Removal of the insulating pane cannot be accomplished without destruction of the spacer strip 22*a*.

The term "translucent" as used herein and in the claims is intended to be construed in a general sense as relating to any capability for the conveyance of light through the material, and the term is intended to include mediums ranging from fully transparent or clear materials to substantially light-dispersing or reflective materials. The capability of supplementing existing panes with tinted or reflective panes is an important option in that panes of this type can be attached in summer months to reduce the entry of sunlight, and hence the creation of solar heat, within an air conditioned space. Alternatively, such panes are often used in winter months to reduce the glare from snow reflection.

Figure 9:
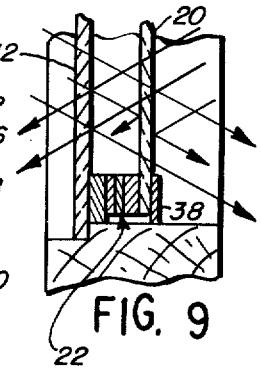
FIGS. 9 and 10 are cross sectional views of an alternate embodiment of the present invention wherein the insulating pane is partially or totally light-reflective.
Figure 10:
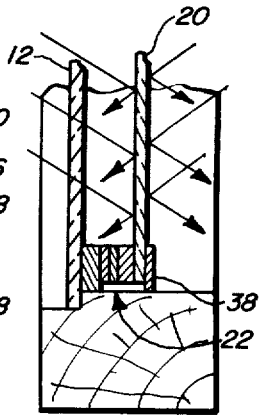

In addition, however, it is contemplated that the removeable panes may be light-altering in nature to an even greater degree in that such panes may be totally opaque, absorptive or reflective for special purposes such as photographic darkrooms or the like. As an illustration of certain of these alternatives the embodiments shown in FIGS. 9 and 10 show the use of insulating panes 20 which are, respectively, partially reflective (FIG. 9) or totally reflective (FIG. 10) of light. Spacer strips 22 and trim strips 38 shown in FIGS. 9 and 10 are identical to those described in the embodiment shown in FIGS. 1-3 above. However, the insulating pane 20 may be suitably opaque, tinted, or coated, as desired, to alter its ability to pass, disperse, or reflect the light rays projecting therethrough.

While the invention has been generally described with reference to mounting on the inside of an existing pane, it will be understood that the spacer strip and insulating pane may be mounted on the outside of an existing pane with equal effectiveness, in which case it will be desirable to provide for inclusion of an additional trim strip of the type shown at 38 of FIGS. 1-4 and 6 about the inwardfacing periphery of the existing pane 12 so as to cover the adhesive otherwise visible through the pane 12 along its peripheral engagement with the spacer strip assembly 22.

From the foregoing it will be appreciated that there has been brought to the art a simplified method and apparatus for enhancing the insulating properties of existing window or door panes, as well as an apparatus for controlling the passage of light through an existing pane for environmental or other reasons. The apparatus described is inexpensive, easy to use and readily adaptable to a wide range of existing pane sizes and configurations.

It will be noted that the spacer strip assembly 22 or the single strip 22*a* (FIG. 8) provides a substantially greater air space than is conventionally provided between double glazed insulating windows of the permanently bonded type. The volume of air trapped between the panes is increased, as required, by the use of thicker spacer strips.

We claim as our invention:

1. In combination:

a window having a sash and at least one fixed pane of flat translucent material surrounded by and fixedly mounted along its edges within said sash, an insulating pane of flat, translucent material of approximately the same shape and of a size slightly smaller than the exposed surface of said fixed pane so that said insulating pane fits interior to said sash, insulating strip means for holding said insulating pane to said fixedly mounted pane including a first insulating spacer strip means having one surface bonded to and along the periphery of said fixed pane and an oppositely facing selectively engageable surface and a second insulating spacer strip means having one surface bonded to and along the periphery of said insulating pane and an oppositely facing selectively engageable surface which intermates with the engageable surface of said first spacer strip means to hold said insulating pane in spaced parallel relation to said fixed pane, said insulating spacer strip means being of material having a low thermal conductivity being sufficiently thick to create an air space between said panes, an insulating strip adhesively mounted to the outside edges of said insulating pane so as to be removable therewith, said insulating strip having a portion which overlaps said spacer strip on the opposite side of said pane and a flexible portion extending outward around the periphery of said insulating pane and into overlapping engagement with said sash so as to create an enclosed air space around the outer periphery of said insulating pane in addition to the air space between the panes.

2. The combination according to claim 1 wherein said selectively engageable surfaces of said first and second spacer strip means consist of an interlocking mesh of minute plastic projections.

3. The combination according to claim 1 wherein said insulating strip is of vinyl material selectively coated with adhesive along an area overlapping the periphery of the insulating pane.

4. In a window system the combination comprising:

a window having a sash and at least one fixed pane of flat translucent material surrounded by and mounted along its edges within the sash;

a supplemental pane of flat translucent material of approximately the same shape and of a size slightly smaller than the exposed surface of said fixed pane;

means for holding said supplemental pane to said fixed pane including (a) a first strip means disposed about the periphery of said fixed pane and having an adhesive-bearing side bonded to said fixed pane and a magnetic side strip opposite said adhesive side, and (b) a second strip means bonded about the periphery of said insulating pane and having a magnetic side which is selectively intermateable with the magnetic side of said first strip means to hold said panes in spaced, parallel relation while allowing selective disengagement thereof, and a flexible insulating strip having a portion adhesively bonded about the periphery of said supplemental pane and a flexible portion extending therebeyond so as to overlap and seal an enclosed air space about the periphery of said supplemental pane within said sash.

5. In a window system the combination according to claims 4 wherein said supplemental pane consists of light-altering material to prevent at least a portion of the light coming through said fixed pane from passing through said supplemental pane.

6. In a window system the combination according to claims 4 wherein said insulating pane has at least one surface thereof coated with light-reflective material.

7. In a window system the combination according to any of claims 1 or 4 wherein said strip means each includes a foam portion for separating the insulating and fixed panes while substantially enclosing the air space therebetween.

8. In a window system the combination according to claims 4 wherein said supplemental pane is made of semi-flexible acrylic to facilitate gradual application and removal thereof.

9. In a window system the combination according to claims 4 wherein said supplemental pane is opaque so as to block all light from passing substantially beyond said fixed pane.

10. In a window insulating system, the combination comprising:

a first pane of flat material and a sash surrounding said first pane and holding the pane in secure engagement, a second pane of flat material conforming substantially in shape to the exposed surface of said first pane and being slightly smaller in size so as to create an air space along the edge of said second pane interior to said sash, a separator strip of insulating foam rubber disposed between said first and second panes about their periphery, said separator strip having first and second oppositely facing sides adhesively bonded to said first and second panes respectively and being of a thickness to hold said panes in spaced parallel relation so as to create an air space therebetween, and trim strip means surrounding the periphery of said second pane and adhesively bonded thereto so as to overlap and conceal the underlying separator strip and having a flexible portion extending beyond the periphery of said second pane into overlapping relation with said sash.

* * * * *